US008783243B2

(12) United States Patent
Hodapp, Jr. et al.

(10) Patent No.: US 8,783,243 B2
(45) Date of Patent: Jul. 22, 2014

(54) LOCKOUT SYSTEM FOR SURFACE BURNERS OF A COOKING APPLIANCE

(75) Inventors: Leo Edward Hodapp, Jr., Louisville, KY (US); Michael Bernard Hitchcock, Louisville, KY (US); William Lee Holbrook, Louisville, KY (US)

(73) Assignee: General Electric Company, Schenectady, NY (US)

( * ) Notice: Subject to any disclaimer, the term of this patent is extended or adjusted under 35 U.S.C. 154(b) by 569 days.

(21) Appl. No.: 12/910,890

(22) Filed: Oct. 25, 2010

(65) Prior Publication Data

US 2012/0100492 A1 Apr. 26, 2012

(51) Int. Cl.
*F24C 3/00* (2006.01)

(52) U.S. Cl.
USPC ..... 126/39 BA; 126/39 R; 431/12; 431/17; 431/2; 431/6; 431/89; 431/90

(58) Field of Classification Search
USPC ..... 431/2, 6, 12, 14, 17, 89, 90; 126/39 R, 126/39 BA
See application file for complete search history.

(56) References Cited

U.S. PATENT DOCUMENTS 2,520,960 A * 9/1950 Ray ..... 431/56
2,614,160 A * 10/1952 Foote et al. ..... 340/644
2,729,221 A * 1/1956 Gorham et al. ..... 137/76
3,021,515 A * 2/1962 Christian et al. ..... 340/525
3,611,364 A * 10/1971 Jones ..... 340/520
3,612,789 A * 10/1971 Marquis et al. ..... 200/47
3,738,178 A * 6/1973 Marquis et al. ..... 74/3.5
3,744,954 A * 7/1973 Faulkner ..... 431/16
4,030,380 A * 6/1977 Mutter ..... 477/79
4,081,235 A * 3/1978 van der Veer ..... 431/54
4,295,129 A * 10/1981 Cade ..... 340/520
4,352,656 A * 10/1982 Michaud et al. ..... 431/72
4,659,909 A * 4/1987 Knutson ..... 219/446.1
4,817,862 A * 4/1989 Bhattacharya ..... 236/10
4,916,628 A * 4/1990 Kugler ..... 700/286
5,042,457 A 8/1991 Gallagher
5,083,505 A 1/1992 Kohlstrung et al.
5,099,822 A 3/1992 Cramer et al.
5,121,880 A * 6/1992 Adams et al. ..... 237/12
5,126,934 A * 6/1992 MacFadyen ..... 700/11
5,139,007 A 8/1992 Bertomeu Martinez
5,179,933 A 1/1993 McCrillis et al.
5,209,217 A 5/1993 Beach et al.
5,213,091 A 5/1993 Beach
5,241,290 A * 8/1993 Sehmer et al. ..... 335/202
5,295,476 A 3/1994 Herbert
5,325,842 A 7/1994 Beach et al.
5,329,918 A 7/1994 Di Bari (Continued)

FOREIGN PATENT DOCUMENTS

CA 2215217 A1 4/1998
CA 2251519 A1 5/2000

(Continued)

*Primary Examiner* — Jorge Pereiro
(74) *Attorney, Agent, or Firm* — Global Patent Operation; Douglas D. Zhang

(57) ABSTRACT

A lockout control system for a cooktop appliance having a surface heating unit includes a controller coupled to the cooktop, a lockout device coupled to the controller, a surface burner state switch coupled between the controller and the lockout device, the surface burner state switch configured to prevent operation of the lockout device when the surface heating unit is enabled.

19 Claims, 5 Drawing Sheets

(56) References Cited

U.S. PATENT DOCUMENTS

| | | | | |
|---|---|---|---|---|
| 5,347,609 | A | 9/1994 | Huff | |
| 5,384,442 | A | 1/1995 | Danner | |
| 5,472,342 | A | 12/1995 | Welsh, II et al. | |
| 5,513,623 | A | 5/1996 | Hong | |
| 5,575,638 | A | 11/1996 | Witham et al. | |
| 5,601,357 | A | 2/1997 | Rangarajan | |
| 5,628,242 | A | 5/1997 | Higley | |
| 5,648,722 | A * | 7/1997 | Merry et al. | 324/417 |
| 5,662,465 | A | 9/1997 | Kano | |
| 5,674,065 | A | 10/1997 | Grando et al. | |
| 5,694,916 | A | 12/1997 | Gambill et al. | |
| 5,706,717 | A * | 1/1998 | Barner | 99/330 |
| 5,713,343 | A | 2/1998 | Taylor et al. | |
| 5,734,206 | A * | 3/1998 | Keizer et al. | 307/116 |
| 5,740,789 | A | 4/1998 | Chang | |
| 5,768,982 | A | 6/1998 | Violi et al. | |
| 5,771,879 | A | 6/1998 | Saltzman | |
| 5,787,874 | A | 8/1998 | Krohn et al. | |
| 5,809,990 | A | 9/1998 | Jones et al. | |
| 5,836,296 | A | 11/1998 | Hillis et al. | |
| 5,875,773 | A | 3/1999 | Jansen | |
| 5,937,846 | A | 8/1999 | Martin et al. | |
| 5,947,370 | A | 9/1999 | Rona et al. | |
| 5,954,045 | A | 9/1999 | Bhanot | |
| 6,011,328 | A * | 1/2000 | Smith | 307/139 |
| 6,030,205 | A | 2/2000 | Maughan | |
| 6,063,421 | A | 5/2000 | Barravecchio | |
| 6,070,517 | A | 6/2000 | Helm | |
| 6,096,987 | A | 8/2000 | Krueger et al. | |
| 6,149,065 | A | 11/2000 | White et al. | |
| 6,164,958 | A * | 12/2000 | Huang et al. | 431/16 |
| 6,205,995 | B1 | 3/2001 | Odenwald | |
| 6,216,683 | B1 | 4/2001 | Maughan | |
| 6,237,638 | B1 | 5/2001 | Asta et al. | |
| 6,331,141 | B1 | 12/2001 | Chua | |
| 6,338,142 | B1 * | 1/2002 | Alsaadi | 713/323 |
| 6,409,500 | B2 | 6/2002 | Georgantas | |
| 6,481,433 | B1 | 11/2002 | Schjerven, Sr. et al. | |
| 6,564,792 | B2 | 5/2003 | Bassoli et al. | |
| 6,618,232 | B2 * | 9/2003 | Huang et al. | 361/93.2 |
| 6,634,351 | B2 | 10/2003 | Arabaolaza | |
| 6,684,875 | B1 | 2/2004 | Schjerven, Sr. et al. | |
| 6,698,417 | B2 | 3/2004 | Frasnetti | |
| 6,843,243 | B2 * | 1/2005 | Steurer | 126/42 |
| 6,877,981 | B1 | 4/2005 | Kim | |
| 6,909,071 | B2 | 6/2005 | Shozo | |
| 6,987,246 | B2 | 1/2006 | Hansen et al. | |
| 6,992,258 | B2 | 1/2006 | Vieira | |
| 7,045,748 | B2 * | 5/2006 | Blackson et al. | 219/446.1 |
| 7,122,766 | B1 | 10/2006 | Main | |
| 7,156,370 | B2 | 1/2007 | Albizuri | |
| 7,168,677 | B2 | 1/2007 | Gama et al. | |
| 7,201,186 | B2 | 4/2007 | Ayastuy | |
| 7,231,917 | B2 | 6/2007 | Frederiksen | |
| 7,255,100 | B2 | 8/2007 | Repper et al. | |
| 7,314,370 | B2 * | 1/2008 | Chian et al. | 431/89 |
| 7,415,979 | B1 | 8/2008 | Macri et al. | |
| 7,479,006 | B2 * | 1/2009 | Newsom | 431/12 |
| 7,481,210 | B2 | 1/2009 | Kim et al. | |
| 7,513,247 | B2 | 4/2009 | Clauss et al. | |
| 7,527,072 | B2 | 5/2009 | Crnkovich | |
| 7,628,607 | B2 | 12/2009 | Gama et al. | |
| 7,834,724 | B2 * | 11/2010 | Rane et al. | 335/120 |
| 7,881,593 | B2 | 2/2011 | Grassi et al. | |
| 8,369,695 | B2 | 2/2013 | Lee et al. | |
| 2001/0011549 | A1 | 8/2001 | Durth et al. | |
| 2001/0024773 | A1 | 9/2001 | Georgantas | |
| 2001/0054234 | A1 | 12/2001 | Asta et al. | |
| 2002/0073985 | A1 | 6/2002 | Leukhardt, III et al. | |
| 2002/0189605 | A1 | 12/2002 | Arabaolaza | |
| 2003/0124475 | A1 | 7/2003 | Frasnetti | |
| 2004/0060554 | A1 | 4/2004 | Schlosser et al. | |
| 2004/0069293 | A1 | 4/2004 | Steurer | |
| 2004/0261632 | A1 | 12/2004 | Hansen et al. | |
| 2005/0019716 | A1 | 1/2005 | Fernandez et al. | |
| 2005/0056634 | A1 | 3/2005 | Shozo | |
| 2005/0098169 | A1 | 5/2005 | Frederiksen | |
| 2005/0199232 | A1 | 9/2005 | Gama et al. | |
| 2005/0199844 | A1 | 9/2005 | Gama et al. | |
| 2005/0208443 | A1 | 9/2005 | Bachinski et al. | |
| 2005/0229918 | A1 * | 10/2005 | Shim | 126/39 BA |
| 2005/0236392 | A1 * | 10/2005 | Blackson et al. | 219/446.1 |
| 2006/0016444 | A1 | 1/2006 | Clauss et al. | |
| 2006/0016445 | A1 * | 1/2006 | Cadima et al. | 126/39 BA |
| 2006/0076005 | A1 | 4/2006 | Kim et al. | |
| 2006/0076529 | A1 | 4/2006 | Ayastuy | |
| 2006/0141409 | A1 * | 6/2006 | Chian et al. | 431/75 |
| 2006/0147861 | A1 | 7/2006 | Czajka et al. | |
| 2006/0150965 | A1 | 7/2006 | Kim et al. | |
| 2006/0175566 | A1 | 8/2006 | Albizuri | |
| 2006/0254573 | A1 | 11/2006 | Steinman et al. | |
| 2007/0006867 | A1 | 1/2007 | Karney et al. | |
| 2007/0084458 | A1 | 4/2007 | Law et al. | |
| 2007/0089731 | A1 | 4/2007 | Chang | |
| 2007/0113838 | A1 | 5/2007 | Czajka et al. | |
| 2007/0125356 | A1 | 6/2007 | Crnkovich | |
| 2007/0204858 | A1 | 9/2007 | Abelbeck | |
| 2007/0292810 | A1 * | 12/2007 | Maiello et al. | 431/59 |
| 2008/0035138 | A1 | 2/2008 | Martin et al. | |
| 2008/0096147 | A1 * | 4/2008 | Newsom | 431/12 |
| 2008/0202496 | A1 | 8/2008 | Albizuri | |
| 2008/0289615 | A1 | 11/2008 | Parrish | |
| 2009/0020019 | A1 | 1/2009 | Potdar | |
| 2009/0126715 | A1 | 5/2009 | Grassi et al. | |
| 2009/0178662 | A1 | 7/2009 | Deng | |
| 2009/0241935 | A1 | 10/2009 | Jaaz et al. | |
| 2010/0072190 | A1 * | 3/2010 | Crucs | 219/492 |
| 2010/0192939 | A1 | 8/2010 | Parks | |
| 2010/0236538 | A1 | 9/2010 | Wah et al. | |
| 2011/0100352 | A1 | 5/2011 | Palmeto et al. | |
| 2011/0270544 | A1 * | 11/2011 | Kucera et al. | 702/58 |
| 2012/0064705 | A1 | 3/2012 | Horsky et al. | |
| 2013/0213384 | A1 | 8/2013 | Albizuri | |

FOREIGN PATENT DOCUMENTS

| | | | |
|---|---|---|---|
| EP | 0 834 698 | A2 | 4/1998 |
| WO | 99/11979 | A1 | 3/1999 |
| WO | 00/08392 | A1 | 2/2000 |
| WO | 01/04523 | A1 | 1/2001 |
| WO | 01/73351 | A1 | 10/2001 |
| WO | 2005/047768 | A2 | 5/2005 |
| WO | 2006/117484 | A1 | 11/2006 |

* cited by examiner

LOCKOUT SYSTEM FOR SURFACE BURNERS OF A COOKING APPLIANCE

BACKGROUND OF THE INVENTION

The present disclosure generally relates to appliances, and more particularly to a surface burner lockout system for a cooking appliance.

Cooking appliances with cooking surfaces that include electric or gas surface heating elements or burners will typically include a lockout feature. The lockout feature provides the ability to lock out or disable the operation of the surface heating elements on the cooktop surface. When a lockout device is deactivated, a check is made prior to reactivation to ensure that none of the appliance or burner controls are in the activated position. If a burner control were to be in an activated position when the lockout device is deactivated, there is the chance that the surface heating element could come on unexpectedly. It is also not desirable to activate the lockout device while the surface heating elements are in use.

A typical implementation will utilize an electronic range control (ERC) device. The electronic range control device will generally monitor and determine a state of the surface heating elements before operation (activation or deactivation) of the lockout device is allowed. This requires additional components, circuitry and connections to sense the state of each surface heating element. It would be advantageous to be able to sense the state of the lockout device in order to determine the state of the surface heating element.

Accordingly, it would be desirable to provide a system that addresses at least some of the problems identified above.

BRIEF DESCRIPTION OF THE INVENTION

As described herein, the exemplary embodiments overcome one or more of the above or other disadvantages known in the art.

One aspect of the exemplary embodiments relates to a lockout control system for a cooktop appliance having a surface heating unit. In one embodiment the lockout control system includes a controller coupled to the cooktop, a lockout device coupled to the controller, a surface burner state switch coupled between the controller and the lockout device, the surface burner state switch configured to prevent operation of the lockout device when the surface heating unit is enabled.

Another aspect of the disclosed embodiments relates to an appliance. In one embodiment the appliance includes a heating unit configured to switch between an active and de-activated state, a control for the heating unit, a burner state switch coupled to the control for the heating unit, and a lockout device configured to switch between a locked and unlocked state of the heating unit; wherein when the appliance generates a lockout device select command to change a state of the lockout device, the state of the lockout device is monitored to determine if the heating unit is in the active state.

A further aspect of the disclosed embodiments relates to a method. In one embodiment the method includes determining a state of a heating unit in an appliance using a controller. The controller generates a lockout device select command, monitors a state of a lockout device for a pre-determined time period, determines if the lockout device changes state responsive to the lockout device select command during the pre-determined time period, and determines that a state of the heating unit is enabled if the lockout device does not change state during the pre-determined time period.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE DISCLOSURE

Figure 1:
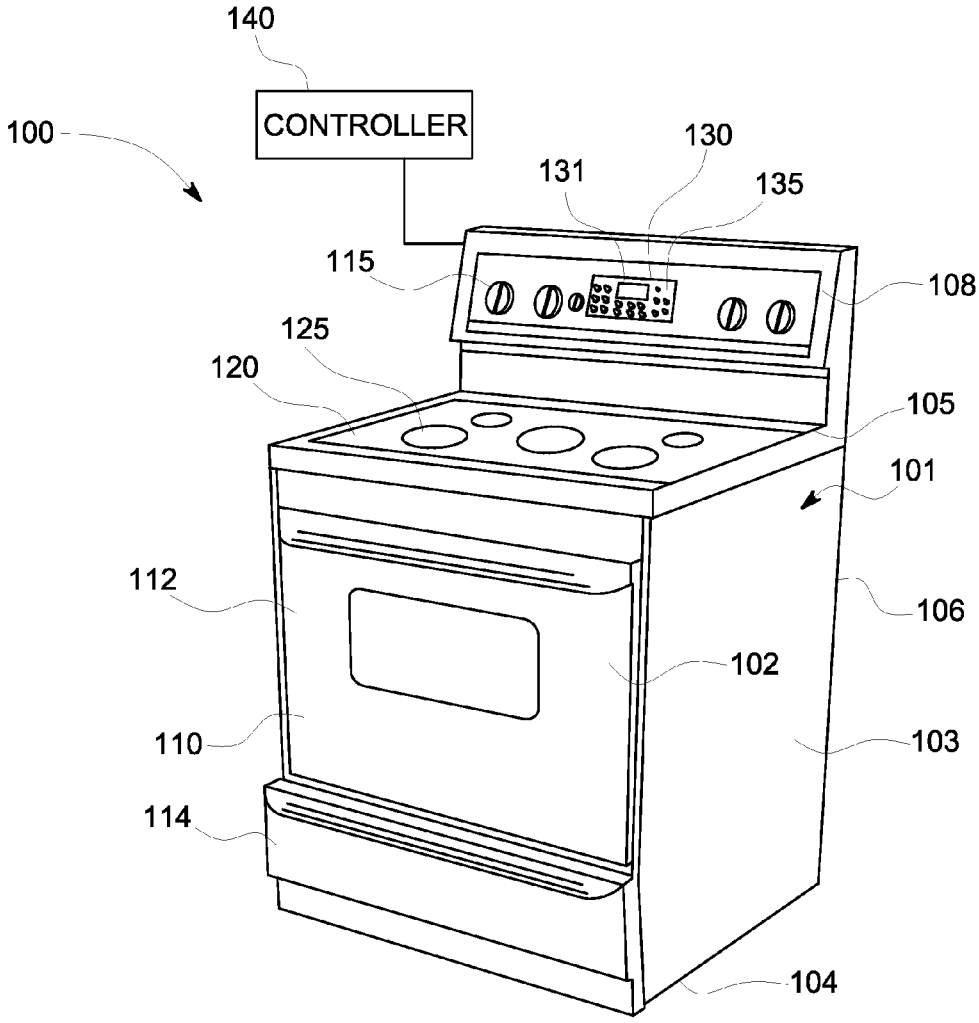
FIG. 1 is a front view of an exemplary range incorporating aspects of the disclosed embodiments.

Referring to FIG. 1, an exemplary appliance such as a free standing range in accordance with the aspects of the disclosed embodiments is generally designated by reference numeral 100. The aspects of the disclosed embodiments are directed to a lockout system for a cooking appliance equipped with a gas or electric cooktop. The aspects of the disclosed embodiments eliminate the need to have separate sensing devices and logic inputs to monitor a state of each surface heating element on the cooktop. Rather, the transitioning or operation of the lockout device is used as the indicator of the status or state of the surface heating elements. Although the aspects of the disclosed embodiments are generally described herein with respect to a cooking appliance, in alternate embodiments any device having a heating unit that can be controlled between on and off states, can be contemplated.

As is shown in FIG. 1, the cooking appliance 100 is generally in the form of a free-standing range or oven that includes a cooktop 120. The range 100 includes a cabinet or housing 101 that has a front portion 102, opposing side panels 103, a base portion 104, a top portion 105, and a back panel 106. The top portion 105 of the oven 100 includes the cooktop 120.

The cooktop 120 includes one or more surface heating units or burner elements, generally referred to as surface heating units 125. Although five surface heating units or burner elements are shown in this example, in alternate embodiments, the range 100 could include more or less than five surface heating units 125.

The range 100 also includes an oven unit 110. Although the aspects of the disclosed embodiments are described herein with respect to the single oven configuration shown in FIG. 1, in alternate embodiments, the range 100 could comprise a stand alone cooktop or a multiple oven unit. The range 100 can also include an oven door 112 and a pullout drawer 114, the operation of which is generally understood.

In one embodiment, the cabinet 101 of the range 100 includes a control surface 108 that supports one or more controls, generally referred to herein as burner control 115. The burner control 115 shown in FIG. 1 is generally in the form of a knob style control. Although the aspects of the disclosed embodiments will generally be described herein with respect to control knobs, in alternate embodiments, any suitable control switches, such as push button or electronic switches, can be used to regulate a state or mode of each of the surface heating units 125. The states or modes of the surface heating units 125 will generally be described herein as "OFF" or "ON", as will generally be understood. The OFF and ON states of the surface heating units 125 are controlled by the respective burner control 115. When a burner control 115 is in a position other than OFF, the respective surface heating unit 125 is generally enabled to be operable. The aspects of the disclosed embodiments will prevent the inadvertent enablement of a surface heating unit 125.

The cabinet 101 also includes a control panel 130, also referred to as a user interface. The control panel 130 can also include a display 131. One aspect of the control panel 130 is to control the general operations of the range 100, including the oven 110 and cooktop 120, as well as provide feedback to the user. The control panel 130 can include one or more controls or switches 135 that can be used to provide control inputs and commands for one or more of the functions of the range 100, including the oven 110 and cooktop 120. In one embodiment, the controls 135 can be in the form of push buttons or electronic switches.

In one embodiment, the oven 100 includes a controller 140. The controller 140 is coupled to, or integrated within, the control panel 130 and configured to receive inputs and commands from for example, the controls 115 and 135, and control the various operations and functions of the oven 100. In one embodiment, the controller 140 can include or comprise an electronic range control.

Figure 2:
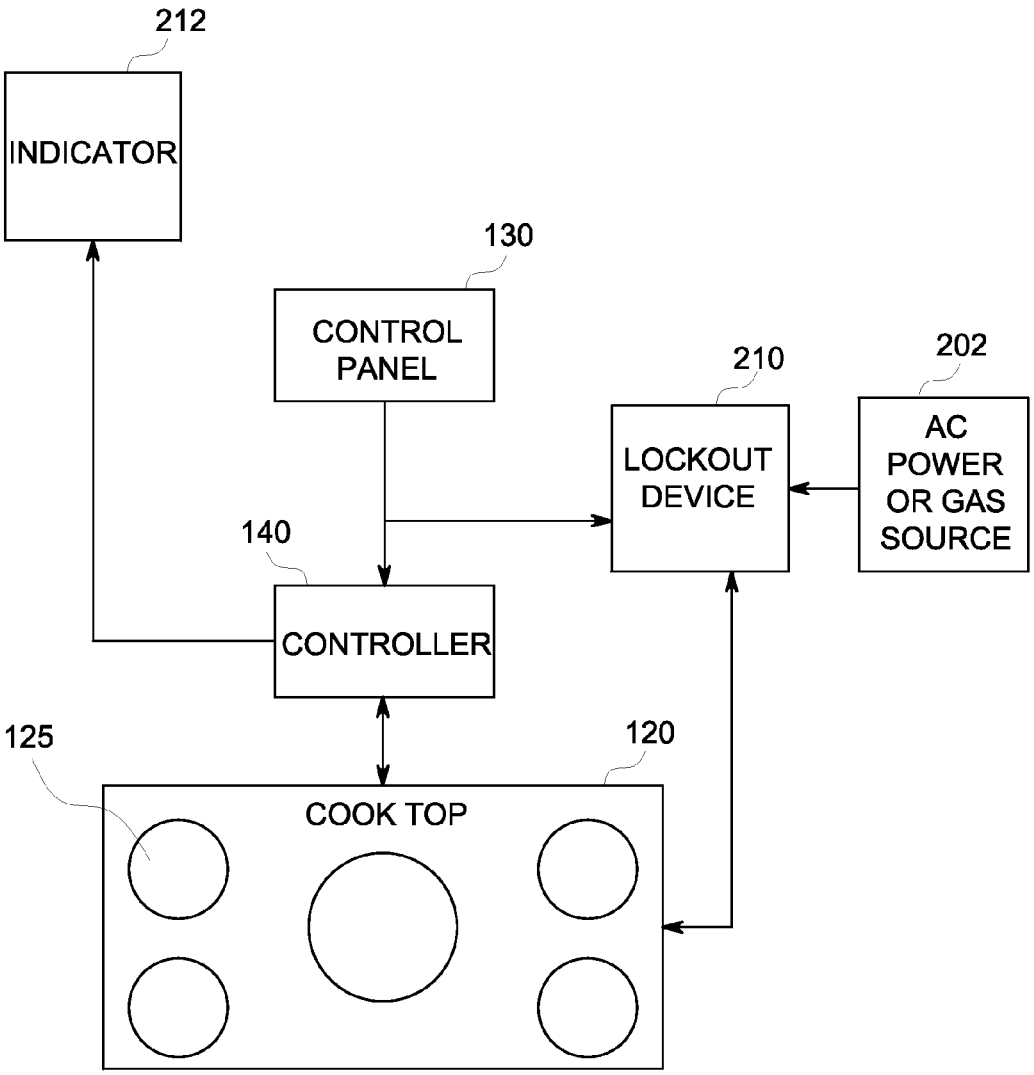
FIG. 2 is a block diagram of one embodiment of an appliance incorporating aspects of the disclosed embodiments.

FIG. 2 illustrates a schematic block diagram of the range 100 incorporating aspects of the disclosed embodiments. In this example, the electronics and/or electrical components of the cooktop 120 are coupled to the controller 140. The controller 140 has a connection to the lockout device 210 for receiving and sending data and information, such as state information of the lockout device 210. The lockout device 210 is generally configured to disable, or make a cooking or heating appliance inoperative by interrupting the circuit connection between the AC Power or Gas Source 202 and the cooktop 120. The lockout device 210 will prevent energy flow to the surface heating units 125. This is advantageous during periods where it is desirable to prevent the inadvertent activation of a surface heating unit 125. In an embodiment where the range 100 is a gas appliance, the lockout device 210 can include a valve lock motor that regulates the flow of gas to the oven 100. When the range 100 is an electrically powered appliance, the lockout device 210 can include an electrical switch, circuit interrupter or interlock device, for example. The lockout device 210 is generally configured to transition between an unlocked state and a locked state.

A lockout request or command from the controller 140 will generally cause the lockout device 210 to transition to the locked state and disable the cooktop 120, and in particular the surface heating units 125. A de-activate or disable lockout request or command will generally cause the lockout device 210 to transition to the unlocked state, allowing the cooktop 120 to be active. Both the lockout command and disable lockout command will generally be referred to herein as a lockout device select command. Although the aspects of the disclosed embodiments are generally described herein with respect to the locking of the cooktop 125, the locking device 210 can also be configured to lock the oven unit 110 as well, and prevent the inadvertent activation of the oven unit 110.

In one embodiment, the lockout device 210 activation is initiated via user interaction with the control panel 130 or automatically by the controller 140. The controller 130 activates the lockout device 210. In alternate embodiments, the lockout device 210 can be activated in any suitable manner. For example, the user may manually request that the lockout mode be enabled by pressing a button 135 on the control panel 130. Or, where the controller 140 is configured to automatically generate a lockout command, after a suitable period of inactivity of the oven 110 or cooktop 120, the lockout device select or enable command is automatically transmitted to the lockout device 210. Requests to de-activate a lockout state are typically made via the control panel 130, although in one embodiment, such unlock commands can be automatically generated as well.

In one embodiment, the range 100 can include an indicator 212 that is configured to indicate the status or state of the lockout device 210. The indicator 212, which, in one embodiment, is part of the control surface 108 or control panel 130, can be any suitable visual indicator such as, for example, an LED or light on the control panel 130. When the lockout device 210 is enabled or active, meaning that the cooktop 120 is in the locked state, the LED 212 is illuminated. In one embodiment, the indicator 212 can also include an audio device or component.

The controller 140 is configured to monitor a state of the lockout device 210 and determine when the lockout device 210 changes state. The aspects of the disclosed embodiments generally encompass three states. An unlocked state, a locked state and a transition state. In the unlocked state or mode, the lockout device 210 is not enabled or active, meaning the cooktop 120 is not locked. In the locked state, the lockout device 210 is enabled or active, meaning the cooktop 120 is locked or disabled. The third state, the transition state, is a state where the lockout device 210 is neither unlocked or locked, and the valve lock motor 210 is being driven. In this state, the lockout device 210 is transitioning to one of the unlocked or locked state. A change of state can generally be considered either a transition from the unlocked to locked state or the locked to unlocked state. It is a feature of the aspects of the disclosed embodiments to determine the state of the surface heating units 125 by monitoring the state, or change in state of the lockout device 210. Although the aspects of the disclosed embodiments are described herein with respect to the state of the surface heating unit 125, the position of the burner control 115 determines the state of the surface heating unit 125. Generally, if the burner control 115 for one of the surface heating units 125 is in position other than OFF, the aspects of the disclosed embodiments will prevent the lockout device 210 from changing state. For example, when the range 100 is in a locked state and a request to de-activate the lockout is requested, the controller 140 is configured to generate a lockout device select command to enable the lockout device 210 to change from the locked to unlocked state. In accordance with the aspects of the disclosed embodiments, the lockout device 210 will only change state if all of the burner controls 115 are in the OFF position. The controller 140 monitors the state of the lockout device 210 for a pre-determined time period to determine if the lockout device 210 changes state. If the lockout device 210 does not change state within the pre-determined time period, it is determined that one or more of the burner controls 115 is not in the OFF position. The aspects of the disclosed embodiments provide the advantage that the controller 140 does not need to separately monitor the state of each surface heating unit 125. Rather, only the state of the lockout device 210 needs to be monitored. The aspects of the present disclosure eliminate the need for additional sensors or connections between the surface heating units 125 and the controller 140. A similar process occurs for a request to lock the cooktop 120.

Figure 3:
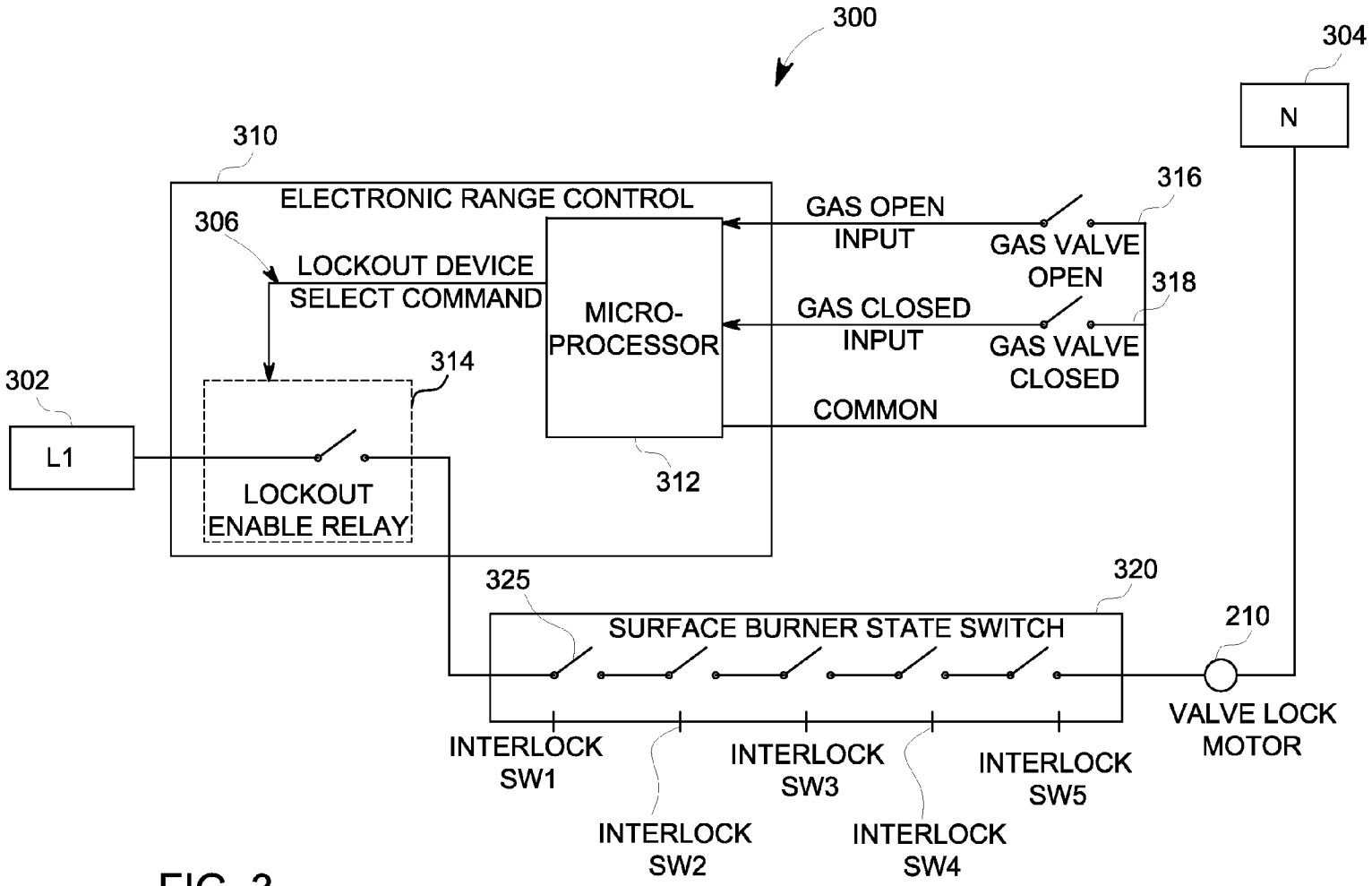
FIG. 3 is a schematic block diagram of an exemplary control system for the range illustrated in FIG. 1.

FIG. 3 illustrates a schematic block diagram of a lockout control system 300 incorporating aspects of the present disclosure. In one embodiment, the lockout control system 300 can be coupled to, or incorporated with the controller 140 of FIG. 1. In alternate embodiments, the lockout control system 300 can be a separate component that is coupled to the controller 140 in a suitable manner, including wired and wireless connections.

As is shown in FIG. 3, in one embodiment, the lockout control system 300 comprises a surface burner state switch device 320 that is coupled between the lockout device 210 and an electronic range control 310. In this example, the range 100 is a gas power range and lockout device 210 comprises a valve lock motor.

The surface burner state switch 320 is configured to monitor a state of each burner control 115. In one embodiment, the burner state switch 320 comprises one or more interlock switches 325, where each interlock switch 325 is associated with a burner control 115 for a surface heating element 125. The interlock switches 325 are connected together to form a series circuit connection. When any one of the interlock switches 325 is open, meaning that a burner control 115 is in a position other than OFF, the circuit connection between the lockout enable relay 314 and the lockout device 210 is in an open state. An open state of any one of the interlock switches 325 will prevent the lockout device 210 from operating by interrupting the power control circuit connection between power elements 302 and 304.

In one embodiment, each switch 325 can be part of an assembly mounted on a shaft of the burner control 115. In this example, the interlock switch 325 is a normally closed switch, which is closed when the burner control 115 is in the OFF position. If the burner control 115 selects any other mode or position, the interlock switch 325 is OPEN. In one embodiment, the interlock switch 325 is a limit switch that is activated by a cam on a shaft of the burner knob control 115 as it is turned from the OFF to the ON position or any other position. The lockout device 210 is prevented from operating, or changing state, if any of the burner controls 115 are in a position other than OFF, and any of the interlock switches is OPEN. In alternate embodiments, the interlock switch 325 can comprise any suitable switch for interrupting a circuit connection when the burner control knob 115 is in any position other than OFF.

The electronic range control 310 is configured to receive lock state transition requests and generate suitable lock state change commands. For example, the user can enter lock state requests on the control panel 130. In one embodiment, the electronic range control 310 includes a lockout enable relay 314 that is configured to provide a circuit connection between the power source 302 and the lockout device 210 when the lockout enable relay 314 is enabled. The lockout device select or enable command 306 will generally cause the lockout enable relay 314 to close for so long as the lockout device select command 306 is active. In one embodiment, the lockout enable relay 314 is configured to remain in the enable or closed state for a pre-determined time period after the lockout device select command 306 is received. The pre-determined time period is generally sufficient to allow the lockout device 210 to fully transition from one state to the other and can be in the range of approximately 4 to 30 seconds. In alternate embodiments, the approximate time period for the lockout device 210 to fully transition from one state to another is dependent upon the type of motor used for the lockout device 210. For example, when a lockout request is generated, the electronic range control 310 can issue a lockout device select command 306. The lockout device select command 306 closes the lockout enable relay 314. The lockout relay enable relay 314 remains closed until the desired state is reached. At the pre-determined period of time, the state of the lockout device 210 is check to determined whether or not the state has transitioned. If the state has transitioned, the lockout device select command 306 causes the lockout enable relay 314 to open. This can include generating a lockout device de-select command. In one embodiment, the lockout device select command 306 comprises a signal having a duty cycle sufficient to allow the lockout device 210 to change from one state to the other during the first part of the signal, after which the lockout device 210 is disabled.

In one embodiment, the processor 312 of the electronic range control 310 is also configured to monitor a state of the lockout device 210. In this example, the range 100 is a gas powered range, and the lockout device 210 is configured to control the flow of gas to the range 100. A gas valve open switch 316 and a gas valve closed switch 318 provide control signal inputs to the electronic range control 310. In one embodiment, the gas valve open switch 316 and gas valve closed switch 318 are controlled by the lockout device 210. When a request to activate or deactivate a lockout is received, the electronic range control 310 is configured to determine a state of the lockout device 210 by monitoring each of the gas valve open and gas valve closed switches 316, 318. If the gas valve open switch 316 is closed, this generally indicates that the lockout device 210 is in the unlocked state. If the gas valve closed switch 318 is closed, this generally indicates that the lockout device 210 is in the locked state.

Once the lockout device select command 306 is issued, the electronic range control 310 is configured to monitor the state of each of the switches 316, 318. In one embodiment, the state of the switches 316, 318 is monitored for the predetermined period of time. If a change in state occurs, meaning that one of the switches 316, 318 opens and the other 318, 316 closes, the lockout device 210 has changed states. If no change from the initial position of the switches 316, 318 is detected, the lockout device 210 has not changed state, meaning that one of the interlock switches 325 is in an open state. Thus, by monitoring the state of the interlock device 210 after a lockout device select command 306 is generated, the state of the surface heating units 125 can be determined.

Figure 4:
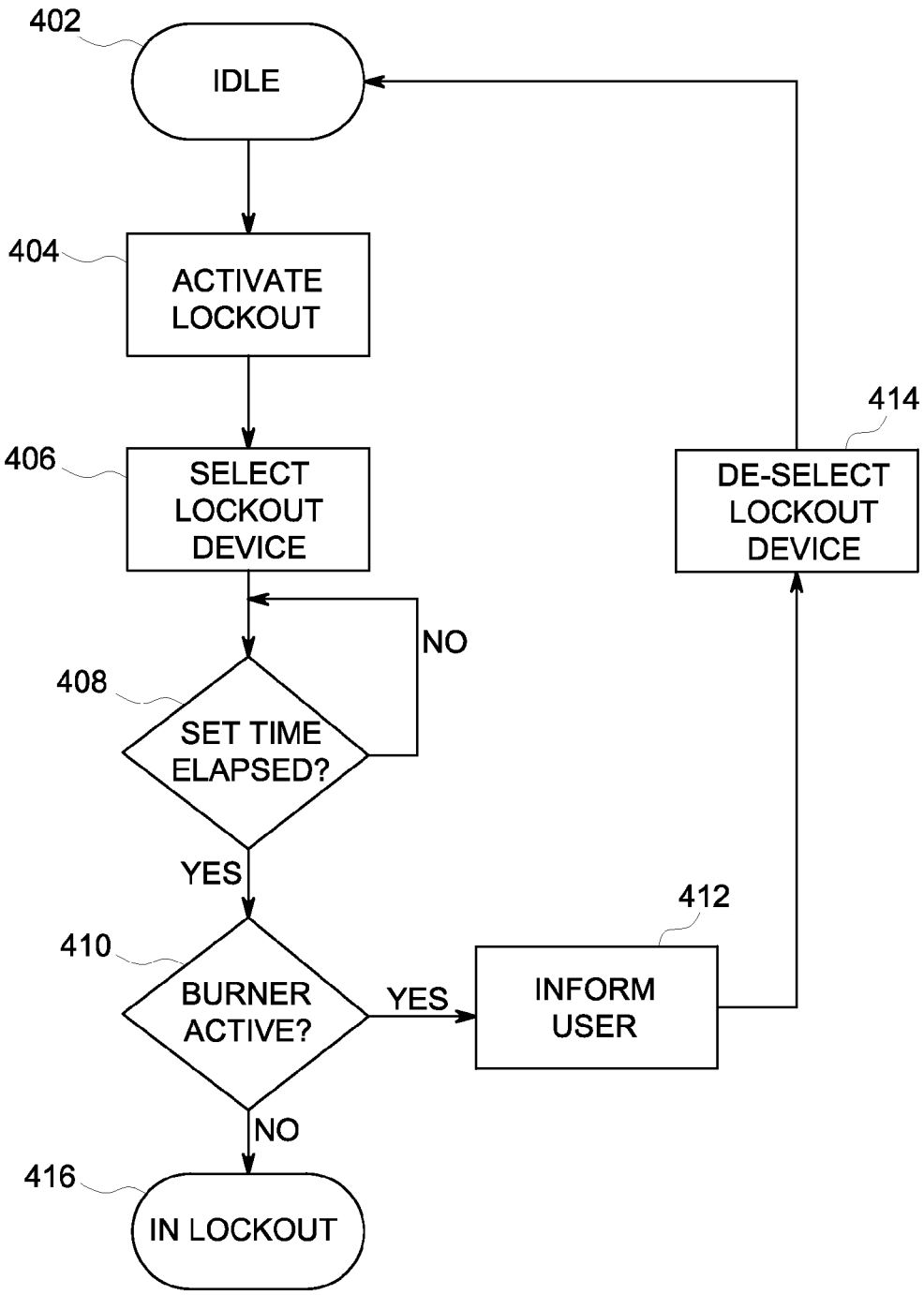
FIG. 4 is a flow chart of a lockout enabling process according to an embodiment of the present disclosure.

FIG. 4 illustrates a flowchart of one embodiment of a lockout process according to the present disclosure. In the example of FIG. 4, the range 100 is in an idle mode 402. An activate lockout command 404 is received and a lockout device select command 306 is generated 406. The generation 406 of the lockout device select command 306 causes the lockout relay 314 of FIG. 3 to close. A state of the lockout device 210 is monitored 408 for a set or pre-determined time period to determine if the lockout device 210 has been activated or changes state. In one embodiment, the set or pre-determined time period is in the range of approximately 4-30 seconds. After the pre-determined period time has elapsed 408, the state of the surface heating units 125 is determined 410. If the lockout device 210 did not change state within the pre-determined time period, one of the surface heating units 125 is active, or the burner control 115 is in a position other than OFF. If it is determined 410 that one of the surface heating units 125 is active, the user is informed 412 and a lockout de-select command 414 is generated to open the lockout enable relay 314. In one embodiment, as described earlier, a separate de-select lockout command 414 is not required where the lockout device select command 306 can cause the lockout device 210 to switch from the locked to unlocked state and unlocked to locked states.

If it is determined 410 that the surface heating elements 125 are not active based on the change of state of the lockout device 210, the range 100 is now in the lockout or disabled state 416 (having previously been in the idle state 402).

Figure 5:
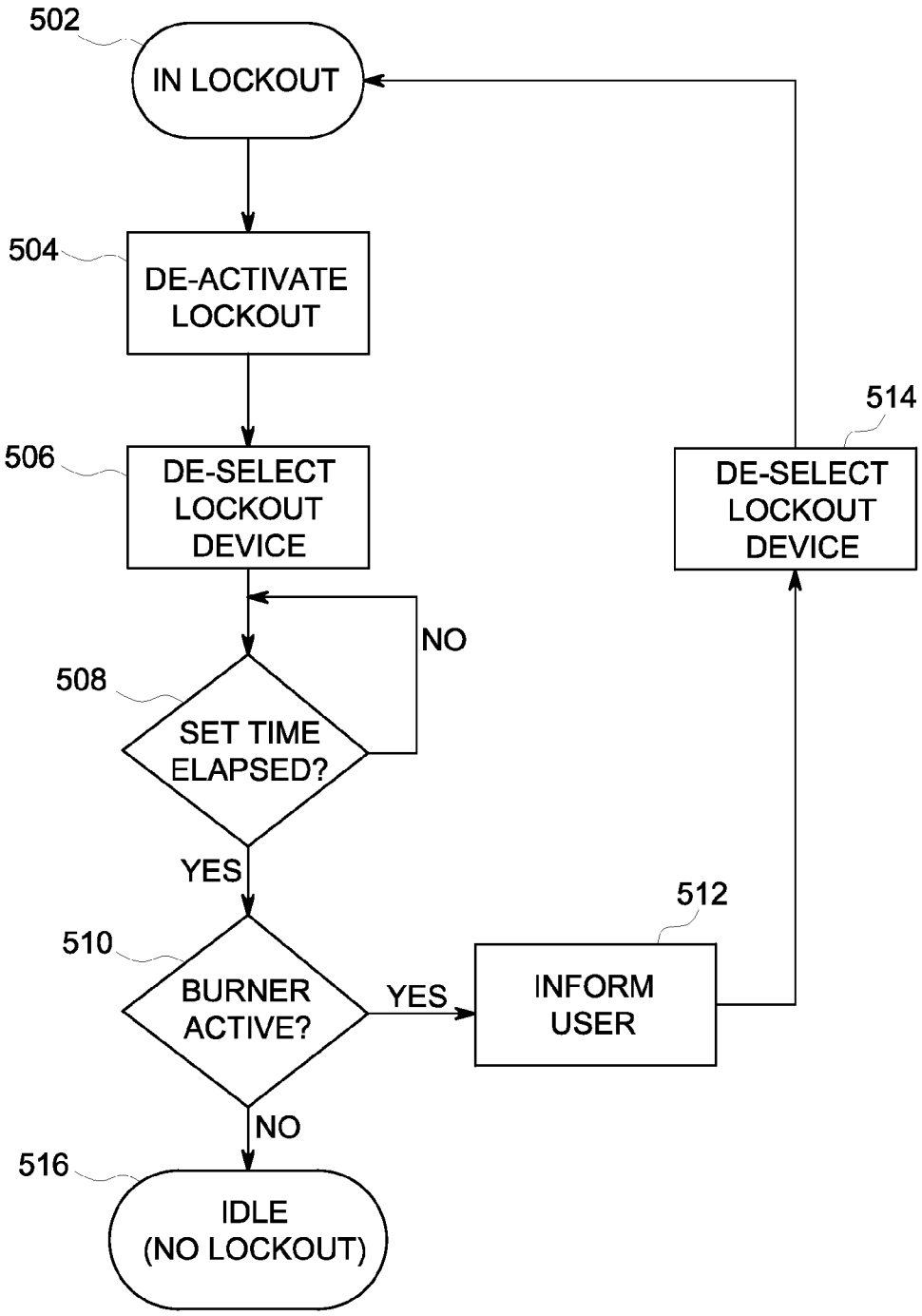
FIG. 5 is a flow chart representing a lockout disabling process according to an embodiment of the present disclosure.

FIG. 5 illustrates an exemplary process for de-activating or disabling a lockout according to one embodiment of the present disclosure. In this example, the oven 100 is in a lockout state 502, generally meaning that the lockout device 210 is in the locked state and the power or gas supply has been interrupted. A deactivate lockout request is received or initiated 504. In one embodiment, the user can manually initiate the request. A de-select Lockout command is generated 506, which enables the Lockout Enable Relay 314. The term "de-select Lockout" is used in this example for descriptive purposes, and the de-select lockout command is the same as the lockout enable command 306 previously described. The state of the lockout device 210 is monitored for a set or pre-determined period of time 508, which in this example is in the range of approximately 4-30 seconds. At the end of the pre-determined time period it is determined 510 whether any of the surface heating units 125 are active. The determination 510 is based on detecting a change of state of the lockout device 210, with respect to the switches 316, 318, as previously described. If is determined 510 that a surface heating unit 125 is active, the user can be informed 512 and a deselect lockout enable command 514 generated. As previously noted, a separate de-select lockout command 514 may not be necessary in the case where the lockout device select command 306 can cause the lockout device 210 to switch from the locked to unlocked state and unlocked to locked states.

If it is determined 510 that the surface heating units 125 are not active based on the change of state of the lockout device 210, the range 100 is now the unlocked or idle state 516 (having previously been in the lockout state 502).

As will generally be understood in the art, self-cleaning or pyrolitic ovens operate in the self-cleaning mode at temperatures that can in some cases exceed 800 degrees Fahrenheit. Safety regulations and standards require that the doors, such as door 112 in FIG. 1, to a self-cleaning oven be securely locked when the temperature of the oven reaches approximately 600 degrees Fahrenheit. Thus, during a self-clean operation, it is generally understood that the door(s) 112 to the oven unit 110 of the oven 100 in FIG. 1 will be locked, and will not unlock until the temperature of the oven unit 110 drops below a pre-determined temperature or set point. In one embodiment, the lockout device 210 will automatically disable the surface heating units 125 during a self-clean operation. When the self-clean operation is complete, and the oven unit 110, has cooled sufficiently, the lockout device 210 is configured to re-enable the surface heating units 125 as is described herein.

In one embodiment, if after the completion of a self-clean operation and sufficient cooling of the oven unit 110, the de-select lockout command 506 cannot cause the deactivation of the lockout device 210 due to a surface heating unit 125 being active, in one embodiment, the door(s) 110 of the oven unit 110 can unlock, but the surface heating units 125 remain disabled due to the locked state of the lockout device 210.

The disclosed embodiments may also include software and computer programs incorporating the process steps and instructions described above. In one embodiment, the programs incorporating the process described herein can be stored on or in a computer program product and executed in one or more computers. The controller 140 illustrated in FIG. 1 can include computer readable program code means stored on a computer readable storage medium, such as a memory for example, for carrying out and executing the process steps described herein. In one embodiment, the computer readable program code is stored in a memory of the controller 140. In alternate embodiments, the computer readable program code can be stored in memory or memory medium that is external to, or remote from, the controller 140. The memory can be direct coupled or wireless coupled to the controller 140.

The controller 140 may be linked to another computer system or controller (not shown), such that the controllers are capable of sending information to each other and receiving information from each other. In one embodiment, the controller 140 could include a server computer or controller adapted to communicate with a network, such as for example, a wireless network or the Internet.

The controller 140 is generally adapted to utilize program storage devices embodying machine-readable program source code, which is adapted to cause the controller 140 to perform the method steps and processes disclosed herein. The program storage devices incorporating aspects of the disclosed embodiments may be devised, made and used as a component of a machine utilizing optics, magnetic properties and/or electronics to perform the procedures and methods disclosed herein. In alternate embodiments, the program storage devices may include magnetic media, such as a diskette, disk, memory stick or computer hard drive, which is readable and executable by a computer. In other alternate embodiments, the program storage devices could include optical disks, read-only-memory ("ROM") floppy disks and semiconductor materials and chips.

The controller 140 may also include one or more processors, such as processor 401, for executing stored programs, and may include a data storage or memory device on its program storage device for the storage of information and data. The computer program or software incorporating the processes and method steps incorporating aspects of the disclosed embodiments may be stored in one or more computer systems or on an otherwise conventional program storage device.

The aspects of the disclosed embodiments allow the state of the surface burner units on a cooktop to be determined by monitoring the state of the lockout device. The need for separate inputs to an electronic range control to monitor the state of each surface burner unit is eliminated. The state of the lockout device provides an indirect means for determining the state of the surface burner elements.

Thus, while there have been shown, described and pointed out, fundamental novel features of the invention as applied to the exemplary embodiments thereof, it will be understood that various omissions and substitutions and changes in the form and details of devices illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A cooktop appliance comprising:

a heating unit for the cooktop appliance configured to switch between an active state and a de-activated state;

a control for the heating unit;

a burner state switch coupled to the control for the heating unit; and a lockout device configured to switch between a locked state and an unlocked state;

wherein when the appliance generates a lockout device select command to change a state of the lockout device, the state of the lockout device is monitored to determine if the heating unit is in the active state; and a gas valve switch controlled by the lockout device, a state of the gas valve switch corresponding to a state of a gas valve for the heating unit, wherein an operation of the lockout device is detected from a change in state of the gas valve switch.

2. The appliance of claim 1, wherein the burner state switch is coupled in series between a control for the lockout device and the lockout device and the lockout device is configured to change state in response to the lockout device select command.

3. The appliance of claim 1, further comprising a lockout enable relay coupled in series between the control and the burner state switch, the lockout enable relay configured to provide a connection between a power control for the lockout device and the burner state switch when the lockout enable relay is enabled.

4. A lockout control system for a cooktop appliance having a surface heating unit, comprising:

a controller coupled to the cooktop;

a lockout device coupled to the controller;

a surface burner state switch coupled between the controller and the lockout device, the surface burner state switch being configured to monitor a state of a surface heating unit control for the surface heating unit and to prevent operation of the lockout device when the surface heating unit is enabled;

the controller comprising a lockout enable relay coupled in series between a power source and the surface burner state switch, the lockout enable relay being configured to energize the lockout device when the lockout enable relay is enabled; and a gas valve switch controlled by the lockout device and coupled to the controller, a state of the gas valve switch indicating a state of a gas valve for the surface heating unit, wherein the controller detects an operation of the lockout device from a change in state of the gas valve switch.

5. The lockout control system of claim 1, wherein a state of the surface burner state switch is open if the surface heating unit is enabled.

6. The lockout control system of claim 5, wherein the surface burner state switch comprises a limit switch.

7. The lockout control system of claim 5, wherein the surface burner state switch comprises one or more interlock switches electrically connected in a series pattern, each interlock switch corresponding to a respective burner control.

8. The lockout control system of claim 7, wherein each interlock switch is configured to be in an open state when the respective burner control is in a position other than OFF.

9. The lockout control system of claim 1, further comprising:

a burner control for the surface heating unit, the burner control coupled to the surface burner state switch; and wherein a state of the surface burner state switch is open when the burner control is in a position other than off.

10. The lockout control system of claim 1, wherein the controller is configured to generate a lockout device select command that is configured to enable the lockout enable relay for a pre-determined time period.

11. The lockout control system of claim 10, wherein the lockout enable relay is automatically disabled at an expiration of the pre-determined time period.

12. The lockout control system of claim 11, wherein a state of the surface burner state switch is open if the state of the lockout device does not change during the pre-determined time period.

13. The lockout control system of claim 10, wherein the controller is configured to monitor a state of the lockout device during the pre-determined time period, and determine that the surface heating unit is enabled if the state of the lockout device does not change during the pre-determined time period.

14. The lockout control system of claim 1, wherein the controller is configured to generate a lockout device select command to change a state of the lockout device, monitor a state of the lockout device, and determine if the lockout device changes state.

15. A method of determining a state of a heating unit in a cooktop appliance using a controller, the controller:

generating a lockout device select command;

monitoring a state of a lockout device for a pre-determined time period;

determining if the lockout device changes state responsive to the lockout device select command during the pre-determined time period; and determining that a state of the heating unit is enabled if the lockout device does not change state during the pre-determined time period; wherein determining if the lockout device changes state responsive to the lockout device select command during the pre-determined time period comprises:

monitoring a state of a gas valve switch for the heating unit controlled by the lockout device; and detecting a change in state of the gas valve switch, the change in state of the gas valve switch indicating the change in state of the lockout device.

16. The method of claim 15, wherein generating the lockout device select command further comprises triggering a lockout device enable relay to provide an electrical connection between the lockout device and a power source.

17. The method of claim 16, wherein triggering the lockout device enable relay comprises establishing the electrical connection for the pre-determined period of time.

18. The method of claim 15, further comprising de-selecting the lockout device select command if it is determined that the state of the heating unit is enabled.

19. The method of claim 15, further comprising automatically de-selecting the lockout device select command at the expiration of the pre-determined time period.

* * * * *